US009163439B2

(12) United States Patent
Tellarini et al.

(10) Patent No.: US 9,163,439 B2
(45) Date of Patent: Oct. 20, 2015

(54) DUAL PROFILE DOORSTOP DEVICE

(71) Applicant: Robert M. Tellarini, Naples, ME (US)

(72) Inventors: Robert M. Tellarini, Naples, ME (US); Harchet S. Hansra, Naples, ME (US)

( * ) Notice: Subject to any disclaimer, the term of this patent is extended or adjusted under 35 U.S.C. 154(b) by 0 days.

(21) Appl. No.: 14/628,864

(22) Filed: Feb. 23, 2015

(65) Prior Publication Data

US 2015/0240541 A1 Aug. 27, 2015

Related U.S. Application Data

(60) Provisional application No. 61/943,547, filed on Feb. 24, 2014.

(51) Int. Cl.
*E05F 5/02* (2006.01)
*E05C 17/54* (2006.01)

(52) U.S. Cl.
CPC ..... *E05C 17/54* (2013.01)

(58) Field of Classification Search
CPC ... Y10T 16/61; Y10T 16/628; Y10T 16/6285; Y10T 292/71; Y10T 292/73; Y10T 292/34; Y10T 292/15; E05C 17/00; E05C 17/54; E05C 17/60; E05C 17/64; E05C 19/004; E05C 19/18; E05C 19/182; E05F 5/00; E05F 5/06; E05F 5/02; E05Y 2201/21; E05Y 2201/218; E05Y 2201/224
See application file for complete search history.

(56) References Cited

U.S. PATENT DOCUMENTS

| | | | | | |
|---|---|---|---|---|---|
| 1,280,048 | A * | 9/1918 | Lavender | 292/95 |
| 2,120,692 | A * | 6/1938 | Butts | 292/343 |
| D197,049 | S * | 12/1963 | Panopoulos | D8/402 |
| 3,328,065 | A * | 6/1967 | Arenson | 292/343 |
| 3,706,112 | A * | 12/1972 | Newell | 16/82 |
| 4,653,140 | A * | 3/1987 | Hudec et al. | 16/82 |
| 4,705,309 | A * | 11/1987 | Sawchuk | 292/342 |
| 5,465,460 | A * | 11/1995 | Cantone | 16/82 |
| 6,016,588 | A * | 1/2000 | Kamerschen | 16/82 |
| D420,570 | S * | 2/2000 | Johnson | D8/402 |
| 6,345,849 | B1 * | 2/2002 | Yen | 292/343 |
| 6,557,915 | B1 * | 5/2003 | Duff | 292/343 |
| 7,506,905 | B1 * | 3/2009 | George | 292/343 |
| 7,644,964 | B2 * | 1/2010 | Bushey et al. | 292/342 |
| 7,690,080 | B1 * | 4/2010 | Coffman, II | 16/82 |
| 7,976,080 | B1 * | 7/2011 | Duff | 292/343 |
| 8,365,355 | B2 * | 2/2013 | Liu | 16/82 |
| 2004/0188583 | A1 * | 9/2004 | Marsh et al. | 248/345.1 |
| 2005/0212017 | A1 * | 9/2005 | Heisserer | 257/257 |
| 2005/0225100 | A1 * | 10/2005 | Pendergrass | 292/343 |
| 2005/0235561 | A1 * | 10/2005 | Bushey | 49/70 |
| 2010/0242226 | A1 * | 9/2010 | Hopkins et al. | 16/82 |
| 2010/0289280 | A1 * | 11/2010 | Nadrowski | 292/343 |
| 2011/0254293 | A1 * | 10/2011 | Duff et al. | 292/343 |
| 2014/0312634 | A1 * | 10/2014 | Cushwa et al. | 292/340 |
| 2014/0312635 | A1 * | 10/2014 | Hansen et al. | 292/343 |

* cited by examiner

*Primary Examiner* — Chuck Mah
(74) *Attorney, Agent, or Firm* — Jeffrey Joyce; Patricia Mathers

(57) ABSTRACT

A dual profile doorstop device that holds a door open or keeps a door closed, or partially open or partially closed, as desired. The device is a unitary component containing two different profiles for restraining the movement of a door; a graduated profile at one end and a stop block or handle profile at the other end, with a relatively thin connector portion extending between the two profiles

7 Claims, 1 Drawing Sheet

DUAL PROFILE DOORSTOP DEVICE

BACKGROUND INFORMATION

1. Field of the Invention

The invention relates to the field of doorstop devices.

2. Discussion of the Prior Art

Conventional doorstops are utilized by inserting some form of wedge between an open door and the floor or by putting some form of block in front of the open door to keep it from swinging shut. These devices are inherently limited because a user must be able to access the device from the side of the door that is propped open. What is needed is a device that can be accessed and adjusted from either side of the door.

BRIEF SUMMARY OF THE INVENTION

The dual profile doorstop device according to the invention is a device that holds a door open or keeps a door closed, or partially open or partially closed as desired. The door is held in such a position when the device is inserted between the door and a floor surface. The device is a unitary component having two different profiles for restraining the movement of a door. The device comprises a wedge or graduated profile at one end and a stop block or handle profile at the other end, with a relatively thin connector portion extending between the two profiles.

Specifically, the device is designed so that the graduated profile may be inserted under one side of a door in a manner that keeps the door fixed in the desired position. The handle allows the position of the door to be fixed from the opposite side of the door. The connector portion fits between the door and the floor surface and connects the graduated profile to the handle. The connector portion is wide enough for the door to be moved onto or off the graduated profile.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
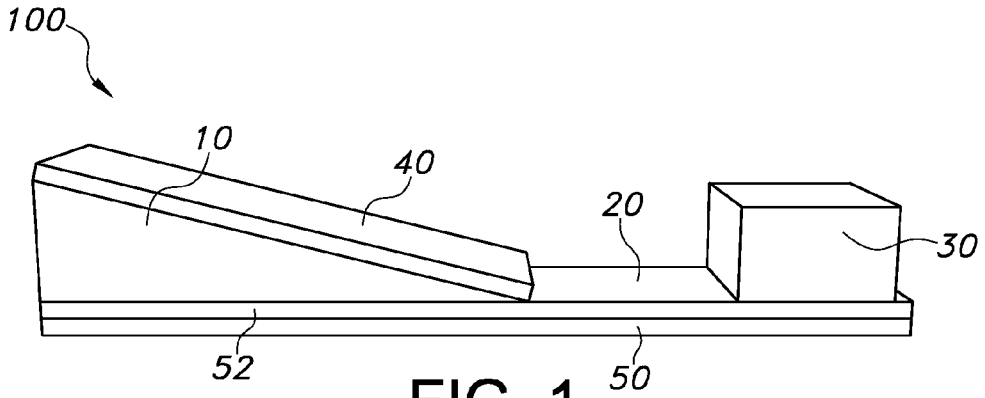
FIG. 1 is a side plan view of the device according to the invention.

FIG. 1 illustrates a dual profile doorstop device 100 for setting the position of a door D, comprising a first profile 10 that is a graduated surface and a second profile 30 that serves as a handle, with a connector 20 extending between the two profiles. The connector 20 has a low, flat profile, relative to the first and second profiles 10, 30 and is dimensioned to accommodate the thickness of the door D and the typical space between the bottom of the door and the floor. The graduated surface 10 may be solid, hollow, or partially hollow. In the embodiment shown, the graduated surface 10 is a solid wedge.

Figure 2:
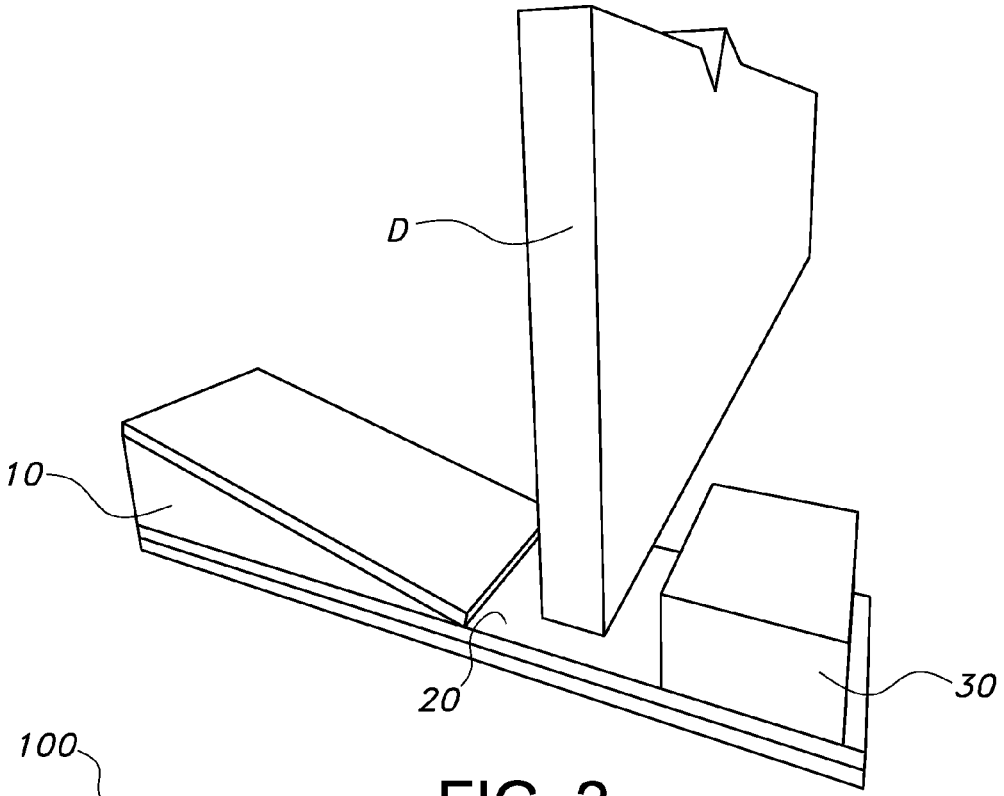
FIG. 2 is a perspective view illustrating use of the device with a door.

FIG. 2 illustrates the device 100 according to the invention in its position of use, placed under the door D. The connector 20 is slid under the door D, so that the door is positioned between the first profile 10 and the second profile 30.

In one instance, the device 100 is used to keep the door slightly ajar. The device 100 is inserted beneath the door D. The door D and the device 100 may then be pushed or pulled into the desired position by using the handle 30 to adjust the position of the device 100. Once the door D and device 100 are both in the desired position, the door D is pushed into a fixed position against the graduated profile 10 while the device is held in place by applying a downward force on the handle 30, for example, by stepping on it.

In another instance, the device 100 is used to secure the door D in the closed position. The connector 20 is placed beneath the door D, which is then moved to the closed position. The handle 30 is then pulled away from the door D in order to forceably wedge the graduated profile 10 under the door D and secure the door D in the closed position.

In the embodiment shown, a grip surface 40 is applied to the upper portion of the first profile 10. For example, a rubber sheet having small ridges may be used as the grip surface 40. The ridges are particularly desirable, because they allow the door to fit firmly against the wedge 10 and become affixed in the desired position. Other suitable materials for the grip surface 40 may include various rubber and plastic materials and may have ridges that are placed in different directions, for example vertical or horizontal lines or v-notches, or may be without ridges.

A base surface 52 is a solid component constructed of wood and is entirely covered in a grip surface 50, to ensure maximum contact with the floor. Other suitable embodiments of the device 100 may be molded components and have a hollow base with only the outer edges making contact with the floor, or have a partially hollow base with multiple connection points with the floor. The device 100 may be constructed of any suitable material, such as rubber or wood.

Figure 3:
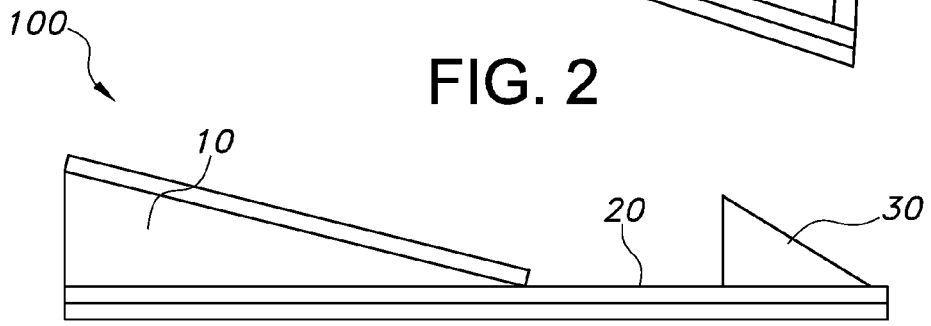
FIG. 3 is a side plan view of the device.

The handle 30 in the embodiment shown in FIGS. 1 and 2 is constructed as a block, however, it is possible that it be constructed to facilitate stepping on it with a foot. FIG. 3 illustrates a second embodiment of the device 100, in which the handle 30 is contoured downward. Other suitable contours are also possible.

It is understood that the embodiments described herein are merely illustrative of the present invention. Variations in the construction of the dual profile doorstop device may be contemplated by one skilled in the art without limiting the intended scope of the invention herein disclosed and as defined by the following claims.

What is claimed is:

1. A doorstop device comprising:

a graduated profile;

a handle; and a connector;

wherein the graduated profile is connected to the handle via the connector such that the three components form a unitary device; and wherein the connector is slidable beneath a door such that the graduated profile is on one side of the door and the handle is on the other side of the door; and wherein the door is wedgeable up against the graduated profile, and the graduated profile is insertable between the door and a floor surface in such a manner that secures the door in a fixed position.

2. A doorstop device of claim 1, wherein the graduated profile is hollow.

3. A doorstop device of claim 1, wherein the graduated profile is solid.

4. A doorstop device of claim 1, wherein the device has a bottom surface and a grip surface is applied thereto.

5. A doorstop device of claim 1, wherein the graduated profile has a top side and a grip surface is thereto.

6. A doorstop device of claim 1, wherein one side of the handle has a downward contour.

7. A doorstop device of claim 1, wherein the handle is in the shape of a block.

* * * * *